US005105329A

United States Patent [19]

Goldner

[11] Patent Number: 5,105,329

[45] Date of Patent: Apr. 14, 1992

[54] APPARATUS FOR DRIVING THE ARMATURE OF AN ELECTRIC STAPLER

[75] Inventor: Sandor Goldner, 1251 46th St., Brooklyn, N.Y. 11219

[73] Assignee: Sandor Goldner, Saddle Brook, N.J.

[21] Appl. No.: 486,247

[22] Filed: Feb. 28, 1990

[51] Int. Cl.[5] ..... H01H 47/04

[52] U.S. Cl. ..... 361/156; 361/194; 361/196; 361/203

[58] Field of Search ..... 361/139, 152, 155, 156, 361/160, 170, 187, 194, 195, 196, 203-205; 227/131

[56] References Cited

U.S. PATENT DOCUMENTS 3,715,605 2/1973 Naber ..... 361/205
3,971,969 7/1976 Wines et al. ..... 361/205
4,333,019 6/1982 Weigert ..... 361/205
4,449,161 5/1984 Kling ..... 361/152

*Primary Examiner*—A. D. Pellinen
*Assistant Examiner*—Jeffrey A. Gaffin
*Attorney, Agent, or Firm*—Fitzpatrick, Cella, Harper & Scinto

[57] ABSTRACT

Solid state control circuitry for driving an electromagnetic armature of a battery operated electric stapler. The armature is activated by a trigger signal generated by a trigger switch which discharges an energy storage device through the armature. Energy is rapidly replenished in the energy storage device following its discharge; but if a subsequent trigger signal is not forthcoming, the control circuit reverts to a quiescent state, thereby reducing power consumption.

17 Claims, 2 Drawing Sheets

APPARATUS FOR DRIVING THE ARMATURE OF AN ELECTRIC STAPLER

BACKGROUND OF THE INVENTION

1. Field of the Invention

This invention relates to apparatus for driving the armature of a battery operated driver, such as an electric stapler, an electric nailer or other power tool to discharge a staple and, more particularly, to such apparatus which rapidly operates in succession, utilizes a minimal amount of external power, and automatically reverts to a quiescent mode within a predetermined time limit after being armed, but not activated.

2. Description of the Prior Art

Electrically powered staplers utilizing a solenoid armature or other electromechanical device for ejecting staples typically are powered by alternating current. As such, these AC powered staplers are plagued with problems associated with power fluctuations in the AC supply lines which result in performance problems including "double stapling" and/or incomplete stapling. To minimize the occurrence of these problems various voltage regulating and control means are employed including full or half wave rectifiers, Zener diodes and SCRs.

D.C. powered staplers utilizing similar solenoid armatures generally do not suffer from problems dealing with fluctuating input voltage, as in A.C. powered staplers. However, D.C. staplers rely on batteries and exhibit the problem of power consumption. Hence, such staplers require a design which minimizes the amount of power consumed thereby so as to increase the effective operating life of the battery. Ideally, an effective design would minimize both the power required to drive each staple and the power drawn while the stapler "waits" to drive a subsequent staple. Conventional D.C. powered stapler designs have failed to provide such a design.

OBJECTS AND SUMMARY OF THE INVENTION

An object of the present invention is to provide apparatus for driving the armature of a battery operated electric stapler which overcomes the foregoing problems associated with the prior art.

It is another object of the present invention to provide apparatus for driving the armature of a battery operated electric stapler which automatically reverts to a low energy mode when not in use.

An additional object of the present invention is to provide solid state circuitry for driving the armature of a battery operated electric stapler.

Yet another object of this invention is to provide apparatus as aforementioned which provides a fast response time between activation of the stapler trigger and the driving of the armature with minimal delay between successive drives of the armature.

In accordance with this invention, apparatus is provided for driving an armature of a battery operated electric stapler. A control circuit is connected to a source of energy for maintaining the apparatus in a low energy standby mode until a trigger is actuated, whereupon a charging circuit is activated to receive energy supplied from the energy source and charge an energy storage device which is connected to the armature to release stored energy to drive the armature. The energy released from the energy storage device is replenished so as to enable subsequent driving of the armature.

Other objects, features and advantages according to the present invention will become apparent from the following detailed description of an illustrated embodiment shown in the accompanying drawing.

DETAILED DESCRIPTION OF A PREFERRED EMBODIMENT

Figure 1:
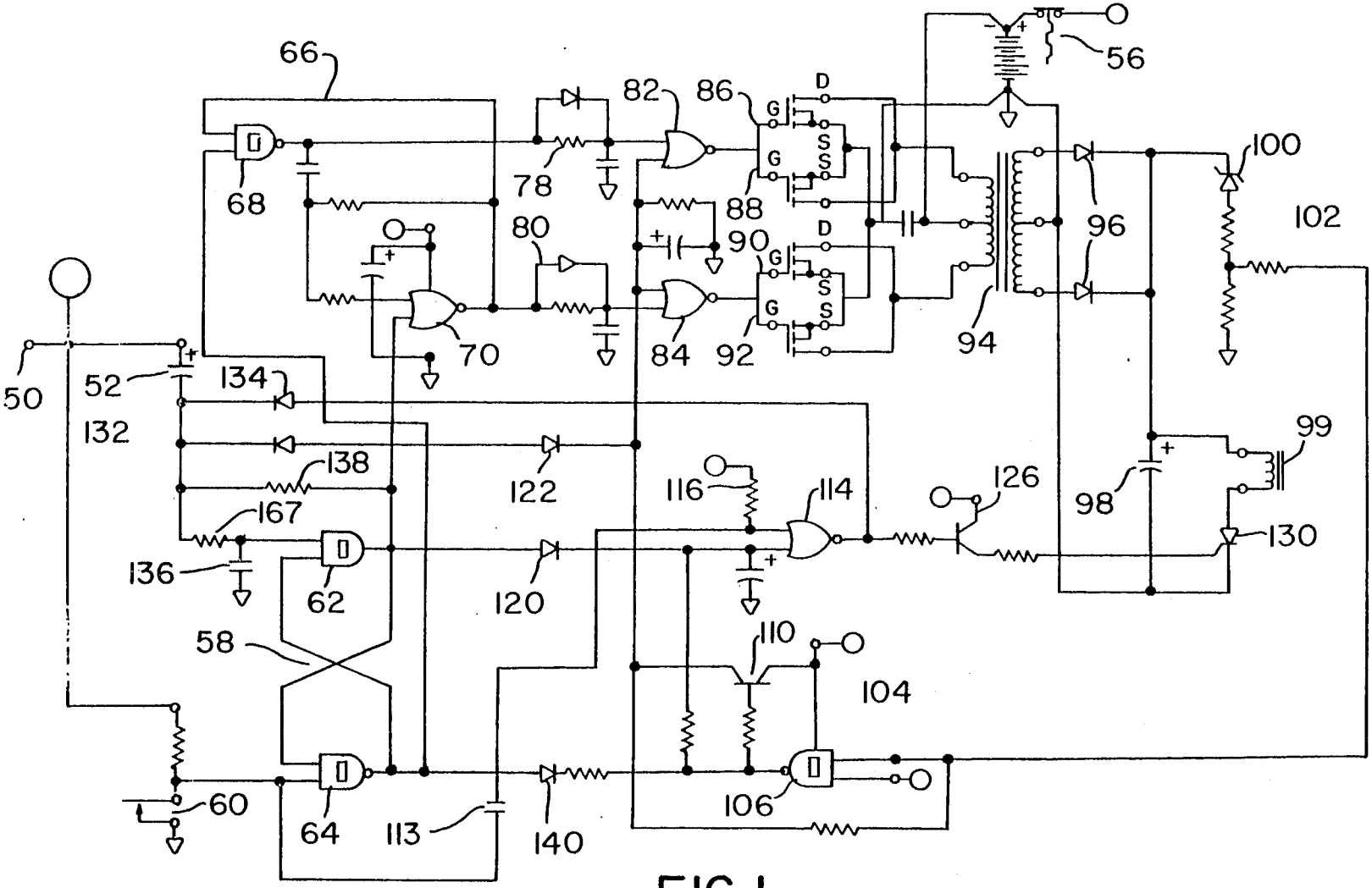
FIG. 1 is a schematic diagram illustrating one embodiment of the present invention.

The apparatus shown in FIG. 1 is comprised of multivibrators 58 and 66, a transformer 94, an energy storage device 98, power reduction circuit 104, a gate 114 and a timer 132. Multivibrator 58 includes two cross-coupled 2-input Schmitt trigger NAND gates, 62 and 64, which operate as reset and set gates, respectively. Schmitt trigger NAND gates are preferred because they prevent oscillation which could occur at the hysteresis point due to noisy or irregular voltage inputs. Preferably, the integrated circuit gates are complementary metal oxide semiconductor (CMOS) gates which draw minimal power in a quiescent state. An input to reset gate 62 is coupled through resistor 67, and timer 132 to an input terminal 50 which is connected to a battery pack or other source of energy to supply operating potential to the illustrated circuit. This D.C. input voltage may be on the order of approximately 7.2 volts. Set gate 64 includes an input connected to a manually operated switch 60 which is adapted to supply a relatively high voltage thereto from input terminal 50 when the switch is open and to supply a relatively low voltage thereto when the switch is closed.

The output from set gate 64 is coupled to an enabling input of multivibrator 66 which includes a 2-input Schmitt trigger NAND gate 68 and a 2-input NOR gate 70 cross-connected to each other. This multivibrator may be replaced by other oscillator circuits known to those of ordinary skill in the art. An input of NOR gate 70 is connected to the output of reset gate 62 and the outputs of gates 68 and 70 are fed to NOR gates 82 and 84, which are contained within power reduction circuit 104 to be described later, via delay circuits 78 and 80, respectively. Gates 82 and 84 are each adapted to drive transistors, such as parallel-connected push-pull driver transistors 86 and 88; and, 90 and 92, respectively. In a preferred embodiment, these transistors are comprised of N-channel enhancement type MOSFET transistors which draw substantially no current at zero gate voltage, thereby minimizing the current drain on the battery so as to maximize efficiency. The gates of these transistors are coupled to NOR gates 82 and 84, as shown. The outputs from each transistor pair are coupled to the primary windings of push-pull step-up transformer 94 whose secondary windings are coupled to energy storage device 98 through a full wave rectifier 96. In an embodiment of the present invention, energy storage device 98 is a capacitor and is connected across stapler armature 99, which is used to drive the staple from the stapler.

The energy storage device is connected to a threshold conduction device or voltage sensing circuit 100, which includes a Zener diode (or other avalanche breakdown device), and senses the energy level of the energy storage device 98. Sensing circuit 100 is coupled to power reduction circuit 104 which is adapted to supply an inhibiting signal to NOR gates 82 and 84 and thereby reduce the overall power drawn by the illustrated drive circuit during a standby, or quiescent, mode. The power reduction circuit includes a 2-input Schmitt trigger NAND gate 106 whose output is coupled to the base of a PNP transistor 110. The collector of transistor 110 is connected to each of NOR gates 82 and 84, and to the input of gate 106 thereby providing positive feedback to gate 106.

Gate 114 includes an input coupled to switch 60 and is adapted to drive a transistor 126 and also to enable timer 132 when switch 60 is manually operated. It will be appreciated that when switch 60 is open, an input of gate 114 is supplied with a relatively high voltage from resistor 116 and when switch 60 is closed this input is supplied with a relatively low voltage from the switch via capacitor 113. Another input of gate 114 is coupled to the output of gate 106 and also to the output of reset gate 62 via a diode 120. The output of gate 114 is coupled to the base of emitter-follower transistor 126 which is adapted to supply a buffered output signal to the trigger of silicon control rectifier (SCR) 130 which is connected in series with armature 99.

The output of gate 114 also is connected by a diode 134 to timer 132 which, when enabled, times out to reset multivibrator 58 whose reset gate 62 has its output connected directly to NOR gate 70 of multivibrator 66 and, by way of a diode 122, to NOR gates 82 and 84.

The output of set gate 64 additionally is coupled to a ready indicator 140, which is adapted to indicate when the energy level of energy storage device 98 is at a level sufficient to drive armature 99. As shown, this ready indicator, which may be an LED, is connected to the output of gate 106.

The individual circuit components without reference designations depicted in FIG. 1 are connected as shown and will not be discussed further, since the connections and values are apparent to those skilled in the art and are not necessary for an understanding of the present invention.

The operation of the illustrated apparatus described above is as follows:

An input D.C. voltage is supplied to input terminal 50 from a standardized nickel-cadmium battery pack module or other suitable source of energy and resets multivibrator 58 through capacitor 52. This reset mode supplies a logic high signal from gate 62 to NOR gates 82 and 84, thereby insuring that a logic low signal is supplied to transistors 86, 88, 90 and 92. Thus, these transistors are placed in a quiescent, low power state. The reset mode also supplies a logic high signal to NOR gate 70 of multivibrator 66, thereby inhibiting the multivibrator and disposing it in a low powered quiescent state. The reset mode further supplies a logic high signal to gate 114, which also receives a logic high signal from input terminal 50. These logic high inputs result in a logic low signal supplied to the base of emitter-follower transistor 126, thus rendering it non-conductive.

Therefore, with switch 60 open, the illustrated circuitry powers up to a standby low power state. The current drain in this state is minimal (for example, approximately 5 microamperes) which assures long battery life even if the battery pack remains inserted for an extended time period.

Upon closing trigger switch 60, a logic low signal is supplied thereby to set gate 64, thereby disposing multivibrator 58 in its set mode to supply a logic high signal from set gate 64 and a logic low signal from reset gate 62. Thus, NOR gates 70, 82 and 84 are enabled. Multivibrator 66 is an a stable multivibrator which is enabled by the logic high signal from gate 64 to generate two out-of-phase square waves (at a frequency of approximately 15 KHz) which are supplied to NOR gates 82 and 84 by delay circuits 78 and 80, wherein the transition portion of each square wave is delayed. This delay results in a time period (approximately 10%) wherein neither square wave is supplied by these NOR gates to transistors 86, 88, 90 and 92. This delay in the transition portion of each wave, or absence of cross conduction, advantageously ensured no overlapping of the signals supplied to the transistors thereby improving the overall efficiency of the circuit.

Transistors 86, 88, 90 and 92 drive push-pull step-up transformer 94 which transforms the D.C. supply voltage (approximately 7.2 volts) to a high level A.C. voltage (approximately 300 volts peak) at the output of its secondary. The push-pull configuration is preferred because it provides large power transfer for a given core size. The output voltage from the transformer secondary is supplied through full wave rectifier 96 to capacitor 98, thereby charging this capacitor. When the voltage across capacitor 98 approaches a predetermined charge level, for example, when the voltage across the capacitor approaches approximately 150 volts, avalanche breakdown of sensing circuit 100 begins, whereby current flows through resistor network 102. In a preferred embodiment, sensing circuit 100 includes a Zener diode with a breakdown or threshold voltage of approximately 150 volts. As capacitor 98 continues to charge, the voltage across resistor network 102 reaches the switching threshold of NAND gate 106 to trigger this NAND gate to produce a logic low signal. This, in turn, enables NOR gate 114 to respond to switch 60 and activates ready indicator 140 in which the light emitting diode (LED) is supplied with a logic high signal by the set state of multivibrator 58. When the indicator is activated, the user is advised that the apparatus is ready to drive a staple. In this condition, capacitor 98 is sufficiently charged, and ready to drive the armature.

The logic low signal produced by gate 106 in response to sensing circuit 100 activates PNP transistor 110, thereby supplying a logic high signal from its collector to NOR gates 82 and 84. As a result, a logic low signal from these NOR gates turns off transistors 86, 88, 90 and 92 which revert to their quiescent state. The logic low signal from gate 106 also supplies an enabling signal to NOR gate 114, thereby permitting a subsequent pulse triggered by switch 60 to pass through gate 114.

Upon a subsequent closure of switch 60, a negative-going pulse with a predetermined time duration set by the values of capacitor 113 and resistor 116 (e.g. on the order of 10 milliseconds) is supplied to NOR gate 114. Since NOR gate 114 was previously enabled by gate 106, this pulse produces a logic high output pulse which passes through emitter-follower transistor 126 to the gate electrode of SCR 130. As a result, capacitor 98 discharges through armature 99 and the SCR, thereby driving armature 99.

Following its discharge, the voltage across capacitor 98 rapidly decreases to less than the threshold voltage limit of sensing circuit 100. Hence, sensing circuit 100 stops conducting and a logic low signal is supplied thereby to NAND gate 106 to produce a logic high signal which deactivates transistor 110, resulting in a logic low output signal from its collector which is supplied as an enabling signal to NOR gates 82 and 84. This enabling signal allows the square wave signals from multivibrator 66 to be supplied to transformer 94 so as to rapidly charge capacitor 98 in the manner previously described. As a result, subsequent drives of the armature can occur on the order of every ½ second.

The logic high output pulse from NOR gate 114 which discharges capacitor 98 also is supplied through diode 134 to discharge capacitor 52 and thus reset timer 132. Once discharged, capacitor 52 now charges through resistor 138 and the logic low signal output of reset gate 62 of multivibrator 58. If, within a predetermined time limit, which is set by the values of capacitor 52 and resistor 138 and is on the order of approximately 5 to 15 seconds, switch 60 is not closed again, capacitor 52 continues to charge until it reaches a level that resets multivibrator 58, thereby turning off multivibrator 66, inhibiting NOR gates 82 and 84 and placing transistors 86, 88, 90 and 92 in the low power standby mode, all as previously described.

Therefore, the first closure of switch 60 is used to place the apparatus in a "ready" state. A second switch closure produces a logic high signal output from gate 114 to drive armature 99, and all subsequent switch closures similarly drive the armature if they occur within the aforementioned predetermined time constraints of timer 132. Otherwise, the apparatus reverts to the stand-by mode which requires two switch closures to again drive the armature.

A thermostat 56 is attached to the transistor heatsink (not shown) upon which transistors 86, 88, 90 and 92 are mounted and is electrically connected in series with the power supply as shown in FIG. 1. The attachment between thermostat 56 and the heatsink provides good thermal conductivity therebetween such that the heatsink temperature is an indication of the transistor temperature. Should transistors 86, 88, 90 or 92 reach a predetermined unsafe temperature, thermostat 56 opens, thereby shutting off power to the illustrated circuit.

Figure 2:
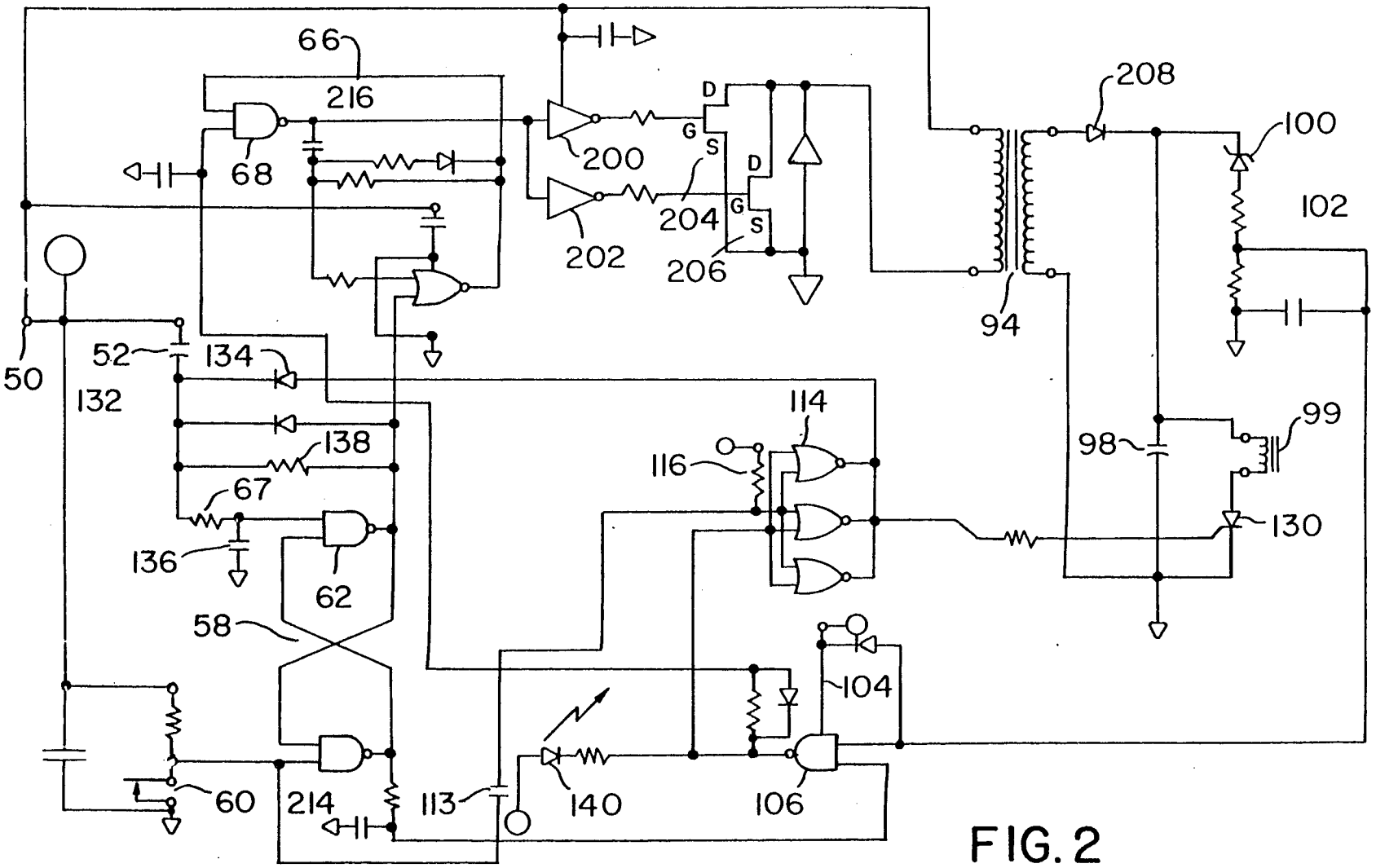
FIG. 2 is a schematic diagram illustrating a second embodiment of the present embodiment.

FIG. 2 shown an alternate embodiment of the present invention which comprises similar circuitry and operates in a similar manner to the apparatus shown in FIG. 1 except as described below. It is to be appreciated that elements similar to those in FIG. 1 are identified by the same reference numerals.

NAND gate 106, which is included in power reduction circuit 104, includes an input coupled to sensing circuit 100 and is adapted to sense the energy level of energy storage device 98. As in FIG. 1, Schmitt trigger NAND gates are preferred. Gate 106 further includes an input coupled through a delay circuit 214 to the output of set gate 64 and is further adapted to detect if multivibrator 58 is in the set state. The output of gate 106 is coupled to NAND gate 68 in multivibrator 66' to indicator 140 and to a gate circut 114'. Gate circuit 114' is similar to and performs substantially the same function as gate 114 of FIG. 1 and includes three gates which are parallelly connected and whose output is coupled through a limiting resistor to SCR 130. A second input to these gates is coupled to switch 60 through capacitor 113.

Multivibrator 66' operates in a manner similar to that of aforedescribed multivibrator 66, but further includes a diode circuit 216 adapted to render the circuit time constant non-symmetrical. That is, the duty cycle of the multivibrator oscillating output differs from, and is preferably less than, 50%. An output from NAND gate 68 is coupled through inverters 200 and 202 to the gate terminals of transistors 204 and 206, respectively. Preferably, these transistors are FETs whose drain terminals are coupled to step-up transformer 94' which is adapted to supply voltage to capacitor 98 from its secondary winding.

The remaining components are connected as previously shown and described with reference to FIG. 1. Furthermore, components without reference numeral designations will not be discussed specifically, since these connections are readily apparent to those skilled in the art.

As previously mentioned, the apparatus in FIG. 2 operates similarly to the apparatus in FIG. 1 except as noted below.

Applying a D.C. voltage to input terminal 50, as by connecting a battery thereto, resets multivibrator 58 thereby supplying a logic high signal to NOR gate 70 and inhibiting multivibrator 66'. Upon closing switch 60, set gate 64 supplies a delayed logic high signal to gate 106 which continues to supply a logic high signal to multivibrator 66' because sensing circuit 100 senses that capacitor 98 is not charged. Closing switch 60 further produces a logic low signal from the output of reset gate 62 which is supplied to NOR gate 70 in multivibrator 66'. Multivibrator 66' is enabled and supplies an oscillating signal comprising a negative pulse with a time duration of approximately 10 millisecond followed by a positive pulse with a time duration of approximately 3 millisecond, to inverters 200 and 202 wherein the pulse signal is buffered, inverted and simultaneously supplied to transistors 204 and 206. Transistors 204 and 206 drive transformer 94' which supplies voltage to capacitor 98, thereby charging this capacitor. When the voltage across capacitor 98 approaches a predetermined charge level (for example, approximately 215 VDC) avalanche breakdown of sensing element 100 begins whereby current flows through network 102.

In response to the output from sensing circuit 100 and a delayed logic high signal from set gate 64 (produced after switch 60 is closed), gate 106 produces a logic low signal which enables gate circuit 114', activates ready indicator 140 and disables multivibrator 66' to inhibit transistors 204 and 206. Upon a subsequent switch closure, gate circuit 114', which is now enabled, receives a negative-going pulse through capacitor 113 and thus supplies a logic high signal to SCR 130 thereby discharging capacitor 98 and driving armature 99.

The transformer secondary is phased so as to back bias diode 208. Upon inhibiting transistors 204 and 206, the magnetic energy in transformer 94' is supplied to capacitor 98.

A thermostat (not shown) may be utilized in a similar manner as previously described for FIG. 1.

Therefore, upon applying a D.C. voltage to terminal 50, multivibrator 58 is reset, which inhibits multivibrator 66' and does not allow an enabling signal to be provided to gate circuit 114', thus, insuring that the circuit powers up in a "safe condition". Furthermore, as in FIG. 1, the first closure of switch 60 places the apparatus in FIG. 2 in a "ready" state, whereupon, a subsequent switch closure, if occurring within a predetermined time as set by timer 132, produces a logic high from gate circuit 114' thereby driving armature 99.

Although a preferred embodiment of the present invention has been described in detail herein, it is to be understood that this invention is not limited to that precise embodiment, and that many modifications and variations may be effected by one skilled in the art without departing from the spirit and scope of the invention as defined by the appended claims.

I claim as my invention:

1. Apparatus for driving the armature of a battery powered device including, an armature, a battery, energy storage means coupled to said armature and triggerable to discharge through said armature to drive the armature; charge means coupled to said energy storage means for supplying energy from said battery to said energy storage means; control means coupled to said charge means for normally disposing said charge means in a quiescent low power state to inhibit said energy storage means from being charged with energy; manually operable trigger means for operating said control means to dispose said charge means in a relatively high power state to supply energy to said energy storage means; discharge means coupled to said trigger means to generate a trigger signal in response to subsequent operation of said trigger means for discharging said energy storage means through said armature; and timing means for operating said control means to inhibit said energy storage means from being charged with energy if said trigger means is not subsequently operated within a predetermined time after energy is supplied to said energy storage means thereby disposing said charge means in said quiescent low power state.

2. Apparatus as set forth in claim 1, wherein said charge means includes sensing means for sensing when energy is stored in said energy storage means to terminate the supply of energy from said battery to said energy storage means.

3. Apparatus as set forth in claim 2, wherein said sensing means includes a Zener diode.

4. Apparatus as set forth in claim 1, wherein said energy storage means is a capacitor.

5. Apparatus as set forth in claim 1, wherein said discharge means includes a silicon control rectifier.

6. Apparatus as set forth in claim 1, wherein said timing means is coupled to said trigger means and responsive to said trigger signal for generating a time-out signal following said predetermined time.

7. Apparatus as set forth in claim 6, wherein said timing means includes a resistor-capacitor circuit for supplying said time-out signal to said control means whereby said energy storage means is inhibited from being charged with energy.

8. Apparatus as set forth in claim 1, wherein said charge means further includes oscillator means for generating drive signals; and transformer means coupled to said oscillator means for supplying to said energy storage means energy derived from said drive signals.

9. Apparatus as set forth in claim 8, wherein said transformer means includes a step-up transformer and a rectifier circuit coupled to said step-up transformer for supplying direct current to said energy storage means.

10. Apparatus as set forth in claim 8, further comprising power reduction means coupled between said oscillator means and said transformer means for inhibiting said drive signals from being supplied to said transformer means; and sensing means for sensing when energy is stored in said energy storage means to activate said power reduction means, thereby reducing energy supplied from said battery.

11. Apparatus as set forth in claim 10, further comprising indicator means responsive to said power reduction means to generate an indication signal when said power reduction means is activated for indicating that energy is stored in said energy storage system.

12. Apparatus as set forth in claim 1, wherein said charge means, control means and timer means include CMOS solid state circuits for minimizing power consumption.

13. Apparatus as set forth in claim 8, which further comprises thermostat means coupled between said battery and said charge means, said thermostat means being responsive to a predetermined temperature of said charge means for shutting off power to said transformer means.

14. Apparatus comprising: an electromagnetic device, a battery, energy storage means coupled to said electromagnetic device triggerable to discharge through said electromagnetic device to drive the electromagnetic device; charge means coupled to said energy storage means and initially inhibited so as to be in a quiescent low power state, said charge means being activated for supplying energy from said battery to said energy storage means; trigger means for activating said charge means to a relatively high power state; and discharge means coupled to said trigger means and responsive to subsequent operation of said trigger means for discharging said energy storage means through said electromagnetic device, said discharge means deactivating said charge means thereby causing said charge means to revert to said quiescent low power state if subsequent operation of said trigger means is no forthcoming within a predetermined time.

15. The apparatus of claim 14 further comprising sensing means for sensing the level of energy stored by said energy storage means, and inhibit means for inhibiting said energy storage means from discharging through said electromagnetic device if the level of energy stored thereby is less than a threshold level.

16. The apparatus of claim 14 further comprising sensing means for sensing the level of energy stored by said energy storage means, and enable means for enabling said energy storage means to discharge through said electromagnetic device in response to said trigger means if the level of energy stored thereby exceeds a threshold level.

17. Apparatus for ejecting a projectile comprising: a low voltage DC battery; battery input means connected to the battery; trigger means connected to said battery for powering-up and arming said apparatus from said battery; drive means responsive to said trigger means when said apparatus is armed for ejecting a projectile; safe power-up means for preventing an unintentional operation of said drive means after the battery is connected to said battery input means; low power-up means for maintaining said apparatus in a low power state when not in se after the battery is connected to said battery; and means responsive to said trigger means for supplying power to said drive means in a relatively high power state; thereby activating said drive means in response to actuation of said trigger means.

* * * * *